US007757853B2

(12) United States Patent
Shinar

(10) Patent No.: US 7,757,853 B2
(45) Date of Patent: Jul. 20, 2010

(54) TISSUE CONTAINER

(75) Inventor: Sarig Shinar, Tel Aviv (IL)

(73) Assignee: 1686592 Ontario Inc. (CA)

( * ) Notice: Subject to any disclaimer, the term of this patent is extended or adjusted under 35 U.S.C. 154(b) by 901 days.

(21) Appl. No.: 11/410,590

(22) Filed: Apr. 24, 2006

(65) Prior Publication Data

US 2006/0283753 A1 Dec. 21, 2006

(30) Foreign Application Priority Data

Jun. 7, 2005 (IL) ..... 169039

(51) Int. Cl.
*B65D 73/00* (2006.01)
*B65D 71/00* (2006.01)

(52) U.S. Cl. ..... 206/494; 206/233; 206/216

(58) Field of Classification Search ..... 206/233, 206/494, 581, 812, 823, 45.21, 45.25, 45.29, 206/170, 784; 229/101, 120.1; 221/34, 46, 221/102; 220/9.2, 9.3, 666, 907
See application file for complete search history.

(56) References Cited

U.S. PATENT DOCUMENTS 2,345,309 A 3/1944 Wensel, Jr.
2,841,275 A * 7/1958 Schwimmer et al. ..... 206/233
2,841,276 A * 7/1958 Schwimmer et al. ..... 206/449
2,916,194 A * 12/1959 Frankenstein ..... 206/45.21
3,095,087 A * 6/1963 Yates ..... 206/449
3,180,555 A * 4/1965 Barrett ..... 229/101
3,270,938 A * 9/1966 Rhinegold ..... 229/101
3,307,687 A * 3/1967 Steinman ..... 206/229
3,372,837 A 3/1968 Neumann
4,879,442 A * 11/1989 Giovine ..... 206/233
4,919,302 A * 4/1990 McPherson ..... 221/34
5,054,612 A 10/1991 Meyer, Jr.
5,165,545 A * 11/1992 Focke et al. ..... 206/494
5,725,310 A * 3/1998 Kruczko ..... 383/11
2001/0040107 A1 * 11/2001 Tourre et al. ..... 206/233

OTHER PUBLICATIONS

Patent Corporation Treaty PCT International Search Report, PCT Application Serial No. PCT/CA2006/000402, Jul. 12, 2006, 3 pp.

* cited by examiner

*Primary Examiner*—Ehud Gartenberg
*Assistant Examiner*—King M Chu
(74) *Attorney, Agent, or Firm*—Fish & Richardson P.C.

(57) ABSTRACT

A tissue dispensing container having a main compartment to hold a stack of tissues, and an auxiliary compartment extendable between a closed position and an open position, adapted to contain waste used tissues. A blank of sheet material specially adapted to permit construction of the above tissue dispensing container is further disclosed.

8 Claims, 5 Drawing Sheets

TISSUE CONTAINER

CROSS-REFERENCE TO RELATED APPLICATIONS

Under 35 U.S.C. 119, this application claims the benefit of a pending foreign priority application filed in Israel on Jun. 7, 2005, entitled "Tissue Container" by Sarig Shinar, and assigned Israeli Application No. 169039. The disclosure of the prior application is considered part of the disclosure of this application and is hereby incorporated herein by reference.

FIELD OF THE INVENTION

This invention relates to tissue dispensing containers, and especially those containers comprising an integrated refuse compartment.

BACKGROUND OF THE INVENTION

It is well known in the art to package tissues in a container which allows for easy dispensing thereof one at a time. These tissues are typically single use, and are in a state to be discarded relatively soon after dispensing. Therefore, such containers are often kept at locations, such as a lavatory or kitchen area, which offer adequate means for disposal of a used tissue. However, it is often advantageous to provide tissues in locations which are not typically equipped with disposal means, such as in a den or study. A user of a tissue must therefore retain the used tissue (or tissues) until such time that a disposal means is convenient, or make a special trip to discard it.

An example of a tissue box fitted with an auxiliary compartment is disclosed in U.S. Pat. No. 4,919,302 directed a tissue box with a disposal compartment including a conventional compartment for the holding and dispensing of new tissues, and a second compartment for the disposal of used tissue which folds out from a side of the new tissue compartment. The used tissue disposal compartment is integrally attached to the new tissue dispensing compartment, having a common sidewall therewith, and may be arranged in a folded position against the common sidewall when not in use, or in an extender position for receiving used tissue. Two foldable sidewalls unfold into the extended position, with the fourth sidewall being attached to the outer edge of the two folding sidewalls. A bottom wall is foldingly attached at the lower end of the common sidewall so that when bent up, into the folded position, it lies against the common sidewall, while in the extended position it rotates down to form the bottom of the used tissue compartment. The bottom wall may be attached to the lower end of the fourth sidewall by a tab extending from the bottom wall and a tub opening in the lower portion of that lower sidewall. Attachment of one or more narrow strips of flexible material between the two foldable sidewalls at their lower edges provides support for the bottom wall and also holds the foldable walls from bowing outwards. The tissue box with disposal compartment may be formed from a single paperboard blank.

SUMMARY OF THE INVENTION

According to the present invention, there is provided a tissue dispensing container comprising a main compartment adapted to hold a stack or a roll of unused tissue, and an integral auxiliary compartment. The auxiliary compartment is extendible between a closed position and an open position, and comprises a top wall, a bottom wall, and sidewalls, at least some of which are foldable when the auxiliary compartment is in the closed position. When the auxiliary compartment is in the closed position, the sidewalls are fully received within the main compartment. A single movement of a user extends the auxiliary compartment into the open position. The tissue dispensing container is typically constructed out of a single blank of sheet material, e.g. cardboard or plastics.

The top wall and bottom wall of the auxiliary compartment are foldable, and the sidewalls thereof are slideable. The single movement of the user entails sliding displacement of the sidewalls and substantial flattening of the top wall and the bottom wall.

The top wall of the main compartment and the auxiliary compartment each comprise a top opening. The top opening of the auxiliary compartment permits its use as a trash receptacle.

The tissue dispensing container further comprises a flap pivotable between a first position associated with the closed position of the auxiliary compartment and a second position associated with the open position of the auxiliary compartment. The flap, in the first position, is adapted to retain the auxiliary compartment in the closed position. In the second position, it is adapted to retain the auxiliary compartment in the open position and to cover a bottom opening formed in the bottom wall of the auxiliary compartment. The bottom opening extends across a large portion of the bottom wall of the auxiliary compartment. In this way, the flap may be temporarily moved from the second position to allow simple emptying of the auxiliary compartment.

The flap is adapted to be fastened into either one of its positions. This may be accomplished by a tab/slot arrangement. Alternatively, an adhesive tab may be used. The adhesive tab is adapted to be repeatedly affixed and removed from the surface of the tissue dispensing container.

The tissue dispensing container further comprises at least one support tab adapted to retain the auxiliary compartment in the open position. The support tabs extend downwardly into a top opening of the auxiliary compartment, and are inwardly foldable along a preformed score.

BRIEF DESCRIPTION OF THE DRAWINGS

In order to understand the invention and to see how it may be carried out in practice, an embodiment will now be described, by way of a non-limiting example only, with reference to the accompanying drawings, in which.

DETAILED DESCRIPTION OF EXEMPLARY EMBODIMENTS

Figure 1:
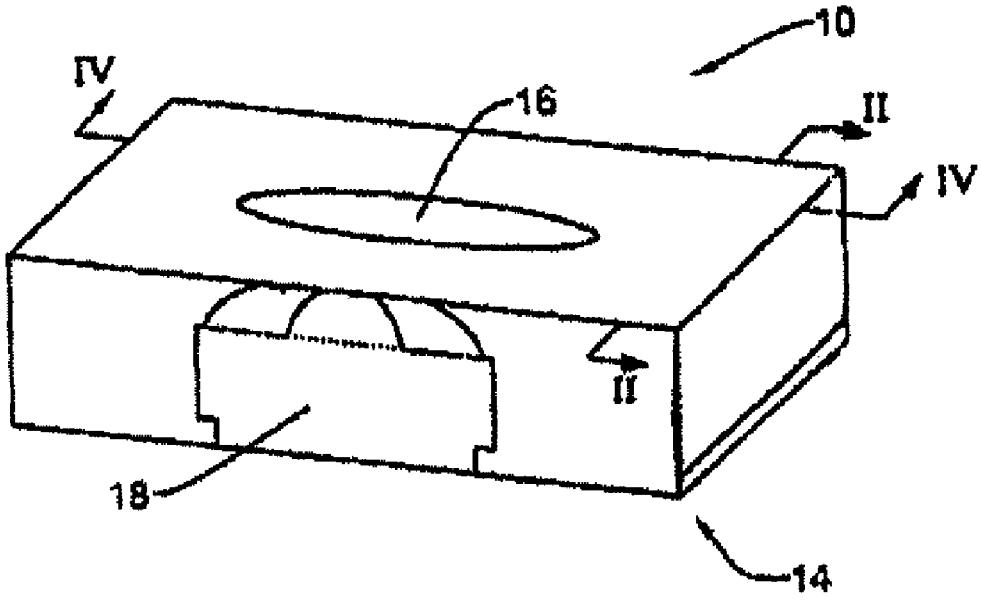
FIG. 1 is a top perspective view of a tissue dispensing container according to the present invention with an auxiliary compartment in a closed position and a flap in a first position.

As seen in FIG. 1, there is provided a tissue dispensing container 10, comprising a main compartment 12 and an auxiliary compartment 14, shown here in a closed position. The main compartment 12 is adapted for storing a stack or a roll of unused tissues, and comprises an aperture 16 for dispensing of tissues therethrough. The container 10 further comprises a flap 18, shown in FIG. 1 in a first position, wherein it is adapted to retain the auxiliary compartment 14 in the closed position.

Figure 2:
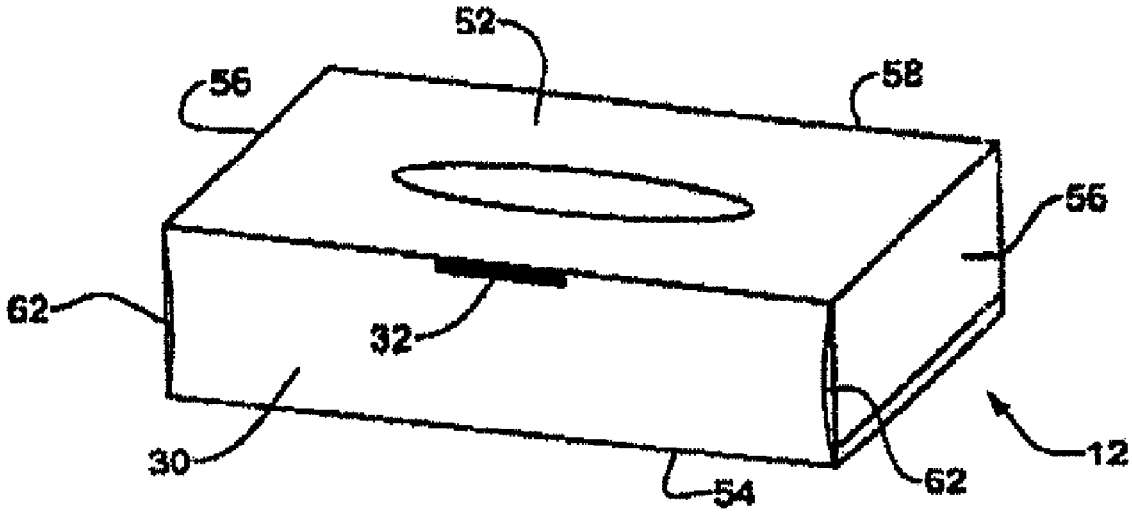
FIG. 2 is a top perspective view of a tissue dispensing container according to the present invention with the auxiliary compartment and flap removed for the sake of illustration only.

FIG. 2 illustrates the main compartment 12 with the auxiliary compartment 14 removed. The main compartment 12 comprises a top wall 52, a bottom wall 54, sidewalls 56, and a back wall 58. A common wall 30 of the main compartment 12 and the auxiliary compartment 14 constitutes a front wall of the main compartment. The common wall 30 comprises a slot 32 adjacent the top edge. The sidewalls 56 are spaced from the common wall 30, forming thereby slits 62.

Figure 3A:
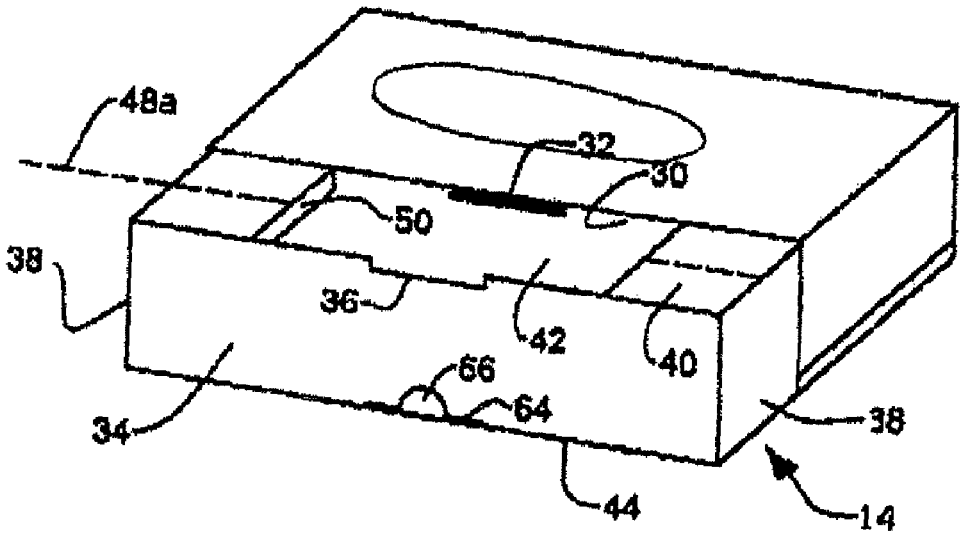
FIGS. 3A and 3B are top and bottom perspective views, respectively, of the tissue dispensing container according to the present invention with the auxiliary compartment in an open position and the flap removed for the sake of illustration only.
Figure 3B:
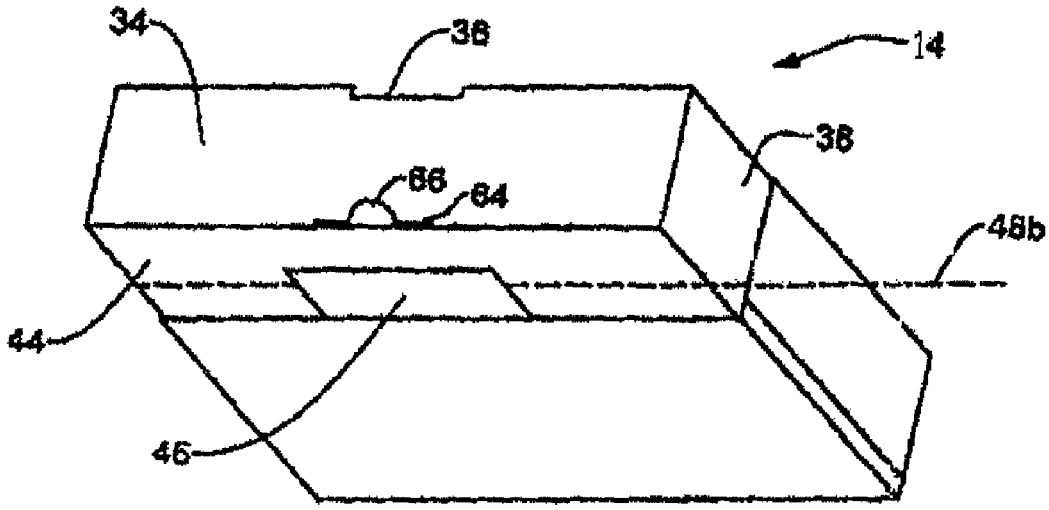

As illustrated in FIGS. 3A and 3B, the auxiliary compartment 14 is enclosed on six sides by the common wall 30, constituting a back wall thereof, a front wall 34, sidewalls 38, a top wall 40 with an opening 42, and a bottom wall 44 with an opening 46. The front wall 34 comprises a notch 36 adjacent a top edge thereof and a slot 64 adjacent a lunular notch 66 at a bottom edge thereof. The top wall 40 and bottom wall 44 are scored on longitudinal axes of symmetry 48*a* and 48*b*. The top wall comprises support tabs 50 adapted to retain the auxiliary compartment in the open position. The sidewalls 38 are attached only to the front wall 34, and are longer than the length of the compartment. They are slidingly received within the slits 62 of the main compartment.

Figure 6:
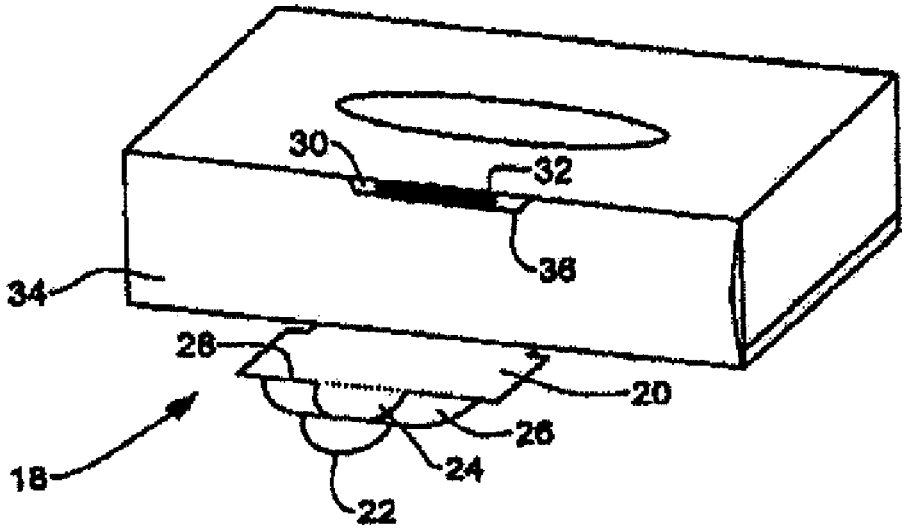
FIG. 6 is a top perspective view of the tissue dispensing container according to the present invention with the auxiliary compartment in the closed position and the flap in an intermediate position.

The flap 18 is best seen in detail in FIG. 6. It comprises a main body portion 20, a first tab 22, and a second tab 24. The second tab 24 is cut out from a secondary body portion 26. The second tab 24 and the secondary body portion 26 are separated from the main body portion by scoring, as indicated by broken line 28. It will be appreciated that the second tab 24 may be folded independently of the second body portion.

The first tab 22 of the flap 18 is used to fasten the flap in the first position. This is accomplished by inserting it into the slot 32 provided in the common wall 30 when the auxiliary compartment 14 is in the closed position, thereby securing it into that position. A notch 36 in the front wall 34 of the auxiliary compartment 14 allows passage of the first tab 22 into the slot 32.

Figure 4:
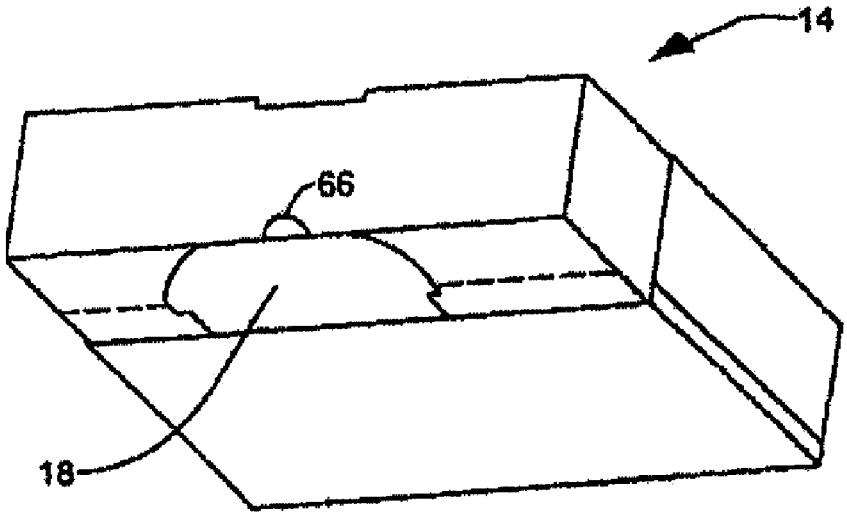
FIG. 4 is a bottom perspective view of the tissue dispensing container according to the present invention with the auxiliary compartment in the open position and the flap in a second position.

The second tab 24 of the flap 18 is used to fasten the flap in a second position, as seen in FIG. 4. This is accomplished by inserting it into the slot 64 provided at the bottom edge of the front wall 34 of the auxiliary compartment 14 when the auxiliary compartment is in the open position, thereby securing it into that position. In this position, the flap 18 is disposed so that it covers the opening 46 of the bottom wall 44 of the auxiliary compartment. The lunular notch 66 is useful for removing the second tab 24 from the inserted position. It should be noted that as seen in FIG. 4, the secondary body portion 26 of the flap 18 may be folded inwardly 180° so that it is not seen when the flap is in the second position. This is for aesthetic purposes only.

Figure 5A:
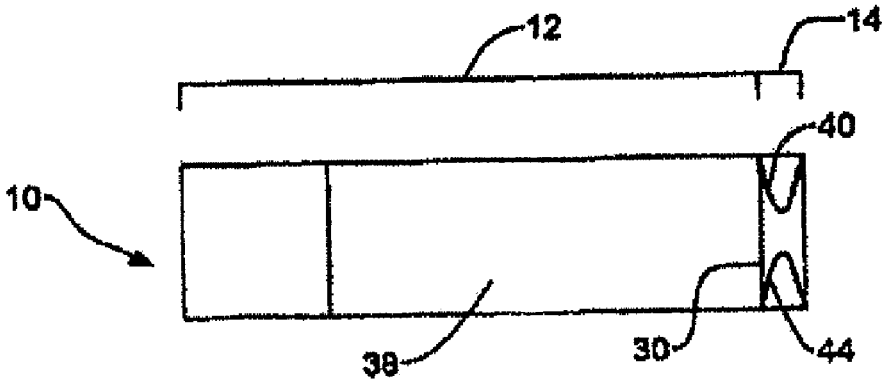
FIGS. 5A and 5B are cross-sectional views taken, respectively, along lines II-II and IV-IV in FIG. 1.
Figure 5B:
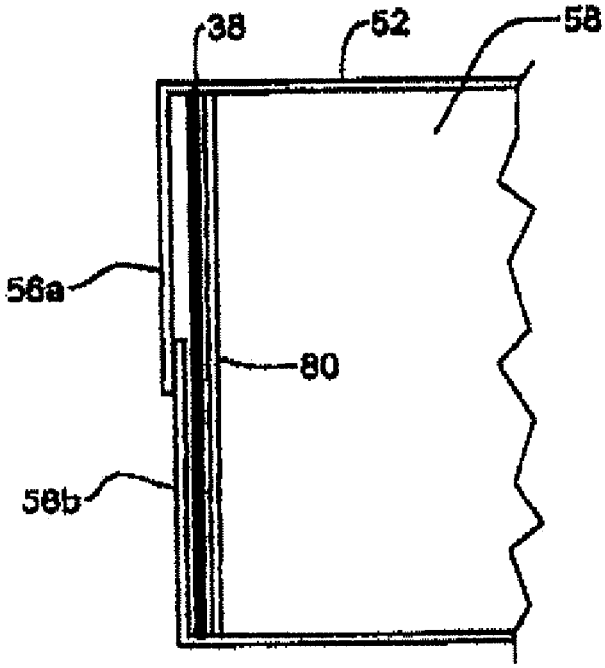

In use, the tissue dispensing container 10 begins with the flap 18 in the first position, securing the auxiliary compartment 14 in the closed position, as seen in FIG. 1. The first tab 22 of the flap 18 is in the slot 32, as described above. As illustrated in cross-section in FIG. 5A, the top wall 40 and the bottom wall 44 of the auxiliary compartment are folded, and the sidewalls 38 thereof are fully received within the slits 62 between the sidewalls of the main compartment 12 and the common wall 30. FIG. 5B illustrated in cross-section how the sidewalls 38 of the auxiliary compartment 14 are received within the main compartment 12, with relation to the sidewalls 56 thereof. It should be noted that FIG. 5B shows the sidewall 56 as comprising a main sidewall top section 56*a* and a main sidewall bottom sections 56*b*. In addition, a flap 80 which extends along the sidewall 56 from the back wall 58 of the main compartment 12, is shown.

In order to extend the auxiliary compartment 14 to the open position, the first tab 22 is removed from the slot 32, and the flap 18 is lowered to the position illustrated in FIG. 6. (This is typically done with one motion.) The main compartment 12 of the container is grasped in one hand, typically around the back wall 58 thereof, and the front wall 34 of the auxiliary compartment 14 is grasped with the other. The front wall 34 is moved away from the main compartment 12. This single movement results in substantial flattening of the top wall 40 and the bottom wall 44 of the auxiliary compartment 14, and sliding displacement of the sidewalls 38 from the slits 62. The second tab is inserted into the slot 64 disposed at the bottom edge of the front wall 34 of the auxiliary compartment 14, securing the flap 18 in the second position, as seem in FIG. 3B. This serves to retain the auxiliary compartment in the open position, as well as to cover the opening 46 of the bottom wall 44 thereof, making the auxiliary compartment useful as a refuse bin. By removing the flap 18 from the opening 46, the auxiliary compartment 14 may be easily emptied of refuse stored therein.

Upon extension of the auxiliary compartment 14 into the open position, the support tabs 50 may be engaged to assist in retention thereof. The support tabs 50 are formed at the top wall 40 of the auxiliary compartment, and are adapted to be inwardly folded to retain the auxiliary compartment.

Figure 7:
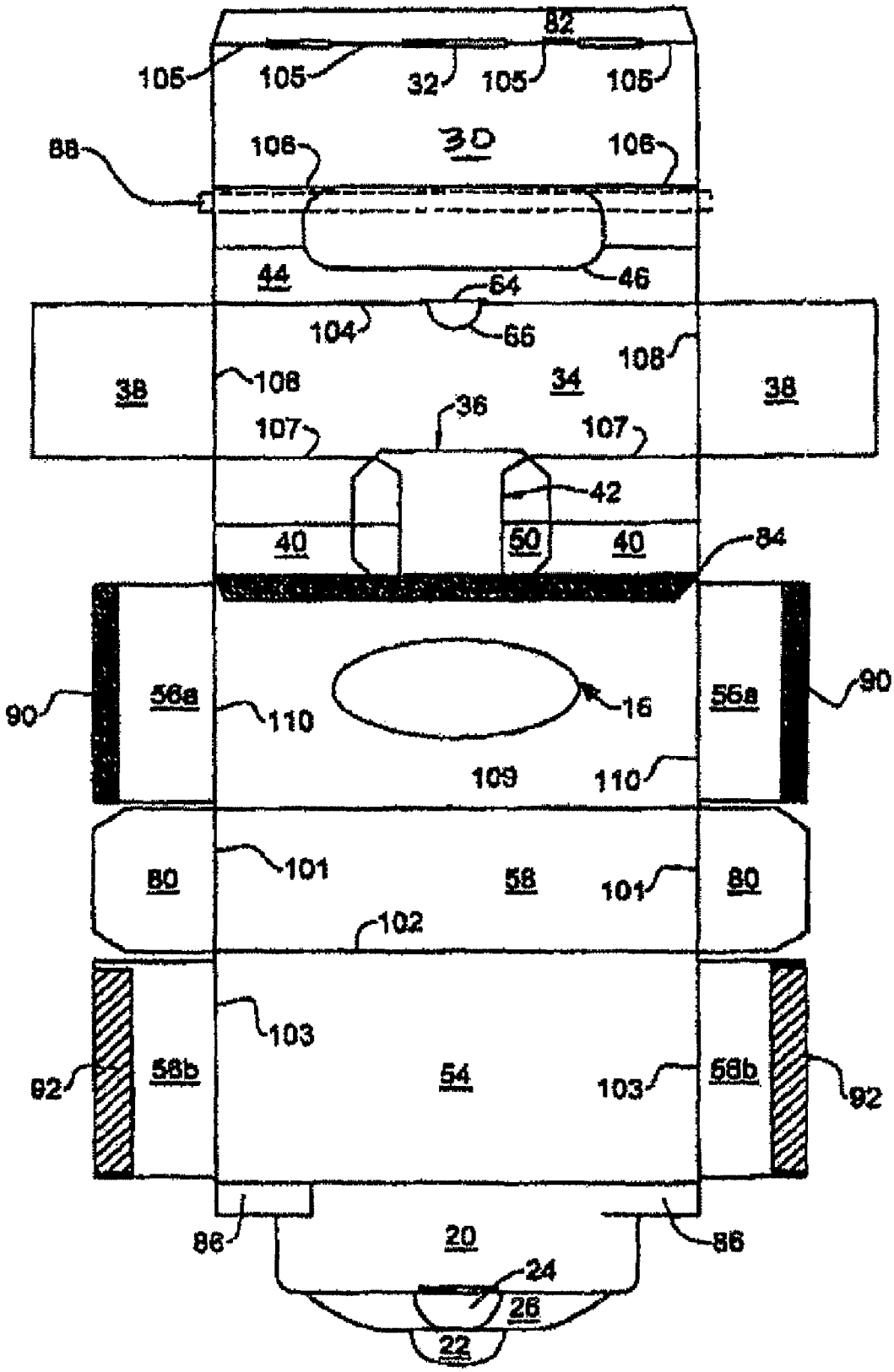
FIG. 7 is a plan view of a blank of sheet material from which the tissue dispensing container according to the present invention may be assembled.

Referring now to FIG. 7, there is seen a single cardboard blank from which the tissue dispensing container 10 may be manufactured. One method of manufacture will be described herein, although it will be appreciated that other methods may be equally acceptable. It is appreciated however that the blank may be manufactured of any suitable sheet material e.g. plastic, etc.

Folds 101 are bent inwardly at right angles. Folds 102 and 103 are bent inwardly at right angles so that main sidewall bottom sections 56*b* abut flaps 80 and are disposed exterior thereto. Fold 104 is bent at a 180° angle so that flap 82 overlaps gluing zone 84, to which it is glued, making sure that the cutout which is to be slot 32 is not obstructed thereby.

Folds 105 through 107 are bent at right angles, and the auxiliary sidewalls 38 are bent inwardly at right angles along folds 108, thereby forming the auxiliary compartment. Fold 109 is bent inwardly at a right angle, so that the auxiliary sidewalls 38 are disposed between main sidewall bottom sections 56*b* and flaps 80. The undersides of tabs 86 are glued to a gluing zone which is located on the reverse side of the blank at a location indicated at 88. Main sidewall top sections 56*a* are bent inwardly along folds 110. Gluing zones 90 are each glued to a corresponding gluing zone on the reverse side of the blank at a location indicated at 92.

Whilst FIG. 7 illustrates a pattern of a blank from which the tissue dispensing container 10 may be manufactured, it is appreciated that a container according to the present invention may be manufactured by other shapes too.

Those skilled in the art to which this invention pertains will readily appreciate that numerous changes, variations and modifications can be made without departing from the scope of the invention mutatis mutandis.

For example, the container may be designed to hold moistened tissues and for this purpose the container will typically be laminated and will comprise a re-sealable closure (e.g. by way of an adhesive tap which is suitable for reopening many times). Alternatively, the container is made of a plastic sheet material.

Furthermore, the auxiliary compartment may be designed in the shape of a closed compartment, i.e. not formed with a bottom opening and where the used tissue opening is closable, for hygiene reasons.

Still, the used tissue opening of the auxiliary compartment may be formed on either side wall of the auxiliary compartment.

Also, the dispensing opening formed on the top wall of the main compartment is fitted with a separating member to facilitate dispensing a single tissue at a time. The dispensing opening may be fitted with an attachment for that purpose, also comprising a re-sealable lid, where such an attachment may be adhered or heat welded to the container.

The invention claimed is:

1. A tissue container comprising main compartment adapted to hold unused tissue, a top of the tissue container configured to permit release of the unused tissue, and an auxiliary compartment extendible between a closed position and an open position; the auxiliary compartment comprising a top wall comprising two distinct sections separated by an opening in between, each section foldable in approximately equal halves along a longitudinal axis of symmetry thereof, a similar-sized bottom wall likewise foldable in approximately equal halves along a longitudinal axis of symmetry thereof, and sidewalls, wherein the auxiliary compartment may be extended from a closed position wherein said sidewalls are slideably received within said main compartment and said top and bottom walls of said auxiliary compartment are in a folded position, to an open position wherein said top and bottom walls thereof are each in an unfolded position and a portion of each of said sidewalls is slideably extended from within said main compartment.

2. A tissue container according to claim 1, wherein the top and bottom walls of the auxiliary compartment are foldable and the sidewalls are slideable, wherein movement to said open position entails sliding displacement of the sidewalls and substantial flattening of the top wall and bottom wall.

3. A single material blank adapted to be folded so as to form a tissue container comprising a main compartment adapted to hold unused tissue, a top of the tissue container configured to permit release of the unused tissue, and an auxiliary compartment extendible between a closed position and an open position; the auxiliary compartment comprising a top wall comprising two distinct sections separated by an opening in between, each section foldable in approximately equal halves along a longitudinal axis of symmetry thereof, a similar-sized bottom wall likewise foldable in approximately equal halves along a longitudinal axis of symmetry thereof, and sidewalls, wherein the auxiliary compartment may be extended from a closed position wherein said sidewalls are slideably received within said main compartment and said top and bottom walls of said auxiliary compartment are in a folded position, to an open position wherein said top and bottom walls thereof are each in an unfolded position and a portion of each of said sidewalls is slideably extended from within said main compartment.

4. A single material blank adapted to be folded so as to form a tissue container having a new tissue compartment and an auxiliary compartment having sidewalls slideably received within said new tissue compartment, said auxiliary compartment integrally attached to said new tissue compartment, comprising: a rectangular area having eight successively joined rectangular subsections, of which, when folded, a first subsection thereof forms a back wall of said auxiliary compartment, a second adjoined subsection forms a bottom wall of said auxiliary compartment, a third adjoined subsection forms a front sidewall of said auxiliary compartment, a fourth adjoined subsection forms a top wall of said auxiliary compartment, the top wall comprising two distinct sections separated by an opening in between, a fifth adjoined subsection forms a top wall of said new tissue compartment, a sixth adjoined subsection forms a back sidewall of said new tissue compartment, a seventh adjoined subsection forms a bottom wall of said new tissue compartment, and an eighth adjoined subsection forms a closure flap; wherein each of said fifth, sixth, and seventh adjoined subsections have, on mutually opposite side edges thereof, outwardly extending portions, each of equal length, which when said fifth, sixth, and seventh adjoined subsections are folded along common adjoined side edges thereof, form respective left and right sidewalls of said new tissue compartment; and wherein each of said second adjoined subsection forming said bottom wall of said auxiliary compartment and said fourth subsection forming said two sections of the top wall of said auxiliary compartment is scored along a longitudinal axis of symmetry thereof to permit folding of each along said respective longitudinal axis of symmetry.

5. The single material blank as claimed in claim 4, wherein said fifth adjoined subsection forming said top wall of said new tissue compartment has an aperture therein to permit removal of tissue from said aperture.

6. The single material blank as claimed in claim 4, wherein said fourth adjoined subsection forming said top wall of said auxiliary compartment possesses a flap portion disposed on either side of said aperture therein and foldable along an axis substantially perpendicularly disposed to said longitudinal axis of symmetry hereof.

7. The single material blank as claimed in claim 4, wherein said fourth adjoined subsection forming said top wall of said auxiliary compartment has said opening therein adapted to permit insertion of tissue into said auxiliary compartment via said opening.

8. The single material blank as claimed in claim 4, wherein said second adjoined subsection forming said bottom wall of said auxiliary compartment has an aperture therein to permit removal of tissue from said auxiliary compartment via said aperture therein.

* * * * *